US005230711A

United States Patent [19]

Keil et al.

[11] Patent Number: 5,230,711

[45] Date of Patent: Jul. 27, 1993

[54] DYEING OF CELLULOSE WITH SOLUBLE SULPHUR DYES WITHOUT REDUCING AGENT

[75] Inventors: Karl-Heinz Keil, Hanau-Mittelbuchen; Thomas Martini, Kelkheim, both of Fed. Rep. of Germany

[73] Assignee: Cassella AG, Frankfurt am Main, Fed. Rep. of Germany

[21] Appl. No.: 861,604

[22] Filed: Apr. 1, 1992

[30] Foreign Application Priority Data

Apr. 15, 1991 [DE] Fed. Rep. of Germany ..... 4112228

[51] Int. Cl.[5] ..... D06M 14/04; D06M 14/22; D06P 3/58; D06P 3/60

[52] U.S. Cl. ..... 8/652; 8/553; 8/554; 8/650; 8/918; 8/552

[58] Field of Search ..... 8/652, 553

[56] References Cited

U.S. PATENT DOCUMENTS

| | | | |
|---|---|---|---|
| 3,514,385 | 5/1970 | Magat et al. | 8/116.1 |
| 3,853,461 | 12/1974 | Willersinn et al. | 8/189 |
| 3,909,195 | 9/1975 | Machell et al. | 8/115.7 |
| 4,737,156 | 4/1988 | Tambor et al. | 8/490 |

FOREIGN PATENT DOCUMENTS 54-131091 10/1979 Japan .

OTHER PUBLICATIONS

Derwent Publications Ltd., Abstract No. 79-84808B of JP-A-65 131 091, Oct. 1979.

Derwent Publications Ltd., Abstract No. 68-11046Q of SU-A-193 020, Jul. 1965.

*Primary Examiner*—A. Lionel Clingman

*Attorney, Agent, or Firm*—Connolly and Hutz

[57] ABSTRACT

Water-soluble sulphur dyes can be applied to cellulose without reducing agents, without added salt and without oxidising agents if the cellulose has been grafted with a polymer obtained by polymerisation of at least one N-containing basic monomer.

20 Claims, No Drawings

DYEING OF CELLULOSE WITH SOLUBLE SULPHUR DYES WITHOUT REDUCING AGENT

The present invention relates to a process for dyeing cellulose with unreduced anionic sulphur dyes. Such unreduced anionic sulphur dyes are in particular the so-called water-soluble sulphur dyes.

Cellulose can be dyed for example with sulphur dyes by the exhaust method from a long or short liquor or by a multiplicity of methods on dyeing machines. It can be dyed semi-continuously for example on pad-roll apparatus or by a pad-batch method e.g. the cold pad-batch method. Sulphur dyes can also be applied to it fully continuously, for example by the pad-steam process or by the continuous thermosol process and others.

To dye with water-insoluble sulphur dyes, they are first converted by reduction, usually with sodium sulphide or sodium sulphydrate, into the soluble leuco form, which has affinity for the fibre, and then applied to the fibre in that form and oxidised thereon. In particular for machine dyeing, sulphur dyes are modified by reaction with alkali metal sulphite or alkali metal bisulphite and made available commercially as so-called water-soluble sulphur dyes. These water-soluble sulphur dyes contain thiosulphuric acid derivatives (Bunte salts) of sulphur dyes. The water-soluble sulphur dyes are soluble in water without reducing agents and develop affinity for the fibre only on addition of reducing agents and alkali.

Dyed articles are expected to have better and better wet fastness properties, in particular good wash fastness properties. However, many sulphur dyes give only moderate wet fastness properties, in particular if applied using certain oxidising methods.

There has therefore been no shortage of attempts to improve the fastness properties of sulphur dyeing by means of aftertreating agents. For instance, the fastness properties of dyeings with sulphur dyes can be improved by the method of EP-A2-0277580 by treating the cellulose before, during or after dyeing with a polymer which contains 16⅔ to 100 mol % of, for example, dimethyldiallylammonium chloride. In this process the sulphur dyes are applied in a conventional manner. In the case of water-soluble sulphur dyes this means that, after they have been dissolved in water, they must first be converted into the fibre-friendly form by reducing them with a reducing agent, for example sodium hydrogen sulphide, sodium sulphide, sodium dithionite ("hydrosulphite"), sodium hydroxymethanesulphinate or glucose, in an alkaline medium. In the actual dyeing process, the rate of exhaustion is increased by adding electrolyte salts, such as Glauber salt or sodium chloride. Following exhaustion onto the fibre, the sulphur dyes must as usual be converted into an insoluble form by oxidation on the fibre. This is done, in particular in piece dyeing, by oxidising with bichromate-acetic acid. Other oxidising agents are for example hydrogen peroxide, for example in conjunction with ammonium acetate, alkali metal salts of hypochlorous acid, ammonium persulphate, alkali metal chlorites, polythionates, alkali metal bromites, potassium iodate, chloramine T, etc.

The necessary presence in the dyeing liquors of reducing and oxidising agents and of high electrolyte concentrations to speed up the rate of dyeing presents problems when it comes to dispose of these liquors after dyeing. It has now been found, surprisingly, that cellulose can be dyed with sulphur dyes which are water-soluble without the addition of reducing agents, i.e. in particular so-called water-soluble sulphur dyes, without reducing agents and high electrolyte concentrations, even at room temperature or slightly elevated temperature, and without the need for oxidation of the dyeing to fix the sulphur dye on the fibre, if the cellulose has beforehand been grafted with a polymer which contains at least one polymerizable, N-containing, basic monomer as copolymerized unit.

The cellulose is grafted by polymerising the polymerisable N-containing basic monomer in the presence of the cellulose. Suitable N-containing basic monomers are in particular compounds of the formula I

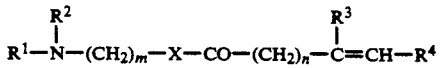

(I)

where $R^1$ and $R^2$ are each hydrogen, $C_1$–$C_6$alkyl, $C_5$–$C_7$cycloalkyl, $C_2$–$C_4$hydroxyalkyl or $R^1$ and $R^2$ together with the nitrogen atom to which they are bonded form a five- or six-membered ring which may additionally contain —O—, —S—, —N= or o—NH—, X is —O— or —NH—, $R^3$ and $R^4$ are each H or $CH_3$, m is 1, 2, 3, 4, 5 or 6, and n is 0, 1, 2, 3 or 4.

$R^1$ and $R^2$ can be identical or different. Similarly, $R^3$ and $R^4$ can be identical or different.

The compounds of the formula I may also be present in the quaternised form Ia:

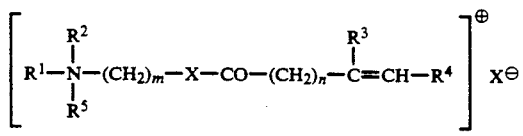

(Ia)

where $R^1$ to $R^4$, X, m and n are each as defined above and $R^5$ is $C_1$–$C_6$alkyl, phenyl-$C_1$–$C_4$alkyl or phenyl-$(O—CH_2CH_2)_p$-, P is 1, 2, 3 or 4, and X⊖ is a monovalent anion or one equivalent of a polyvalent anion.

m is preferably 2 or 3 and n is preferably 0. X is preferably —NH—.

The monovalent anion X⊖ can for example a monovalent radical of a mineral, sulphonic or carboxylic acid, or one anion equivalent of a polybasic mineral, sulphonic or carboxylic acid. A monovalent anion X⊖ can be for example, nitrate, hydrogen sulphate, benzene sulphonate, fluoride, chloride, bromide, iodide, acetate, propionate or some other carboxylic acid radical. One equivalent of a polyvalent anion could be for example ½ an equivalent of sulphate or ⅓ an equivalent of phosphate. Preferably, X⊖ is a halogen anion, such as bromide or iodide, but in particular chloride.

Suitable polymerisable N-containing basic monomers also include in particular compounds of the formula II and/or IIa

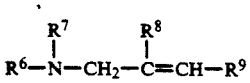

(II)

-continued

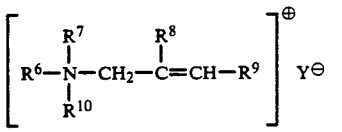

(IIa)

where $R^6$ is H, $C_1$-$C_6$alkyl, $C_5$-$C_7$cycloalkyl or $C_2$-$C_4$-hydroxyalkyl, $R^7$ is H, $C_1$-$C_6$alkyl, $C_5$-$C_7$cycloalkyl or $R^9$—CH=C($R^8$)—$CH_2$—, or $R^6$ and $R^7$ together with the nitrogen atom to which they are bonded form a five- or six-membered ring which may additionally contain —O—, —S—, —N= or —NH—, $R^8$ and $R^9$ are each H or $CH_3$, $R^{10}$ is $C_1$-$C_6$alkyl, phenyl-$C_1$-$C_4$alkyl or phenyl-$(O—CH_2CH_2)_p$-, p is 1, 2, 3 or 4, and $Y^\ominus$ is a is a monovalent anion or one equivalent of a polyvalent anion.

$R^6$ and $R^7$ can be identical or different. Similarly $R^8$ and $R^9$ can be identical or different. Alkyl radicals and hydroxyalkyl radicals can be straight-chain or branched.

Examples of suitable alkyl $R^1$, $R^2$, $R^5$, $R^6$, $R^7$ or $R^{10}$ are methyl, ethyl, propyl, isopropyl, butyl, sec-butyl, iso-butyl, pentyl and hexyl.

Examples of cycloalkyl are cyclopentyl, cyclohexyl and cycloheptyl. Cyclohexyl is preferred.

Examples of hydroxyalkyl are 2-hydroxyethyl, 2- or 3-hydroxypropyl, 2-, 3- or 4-hydroxybutyl and 2-methyl-3-hydroxypropyl.

$R^1$ and $R^2$ the one hand and $R^6$ and $R^7$ on the other can also be combined with the N atom to which they are bonded into a five- or six-membered ring which can be saturated or unsaturated and/or additionally contain —O—, —S—, —N= or —NH—. Examples of such five- or six-membered rings are pyrrolidinyl, piperidino, pyrrolyl, pyridinyl, piperazinyl, morpholino and thiomorpholino.

In phenyl-$C_1$-$C_4$alkyl, the alkyl can be straight-chain or branched. Examples of such phenalkyl radicals are benzyl, phenethyl, 3-phenylpropyl, 2-phenylpropyl and 3- or 4-phenylbutyl, of which benzyl is preferred.

Examples of phenyl-$(OCH_2CH_2)_p$- radicals are phenyl-$(OCH_2CH_2)$-, phenyl-$(OCH_2CH_2)_2$-, phenyl-$(OCH_2CH_2)_4$. The monovalent anion $Y^\ominus$ can have one of the meanings given for $X^\ominus$ and even be identical to $X^\ominus$. Particularly suitable and preferred compounds of the formula I are for example:

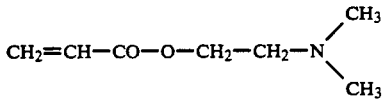

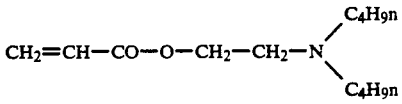

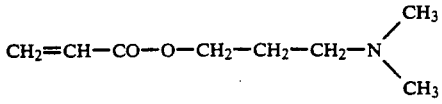

-continued

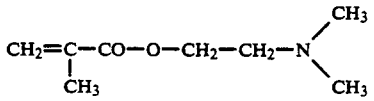

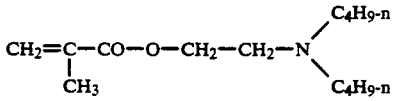

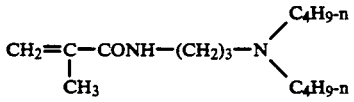

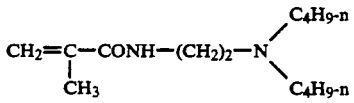

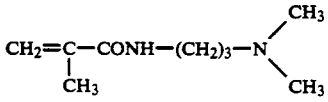

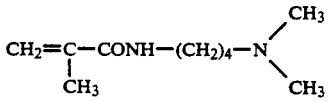

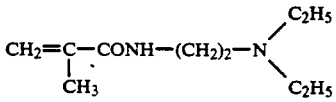

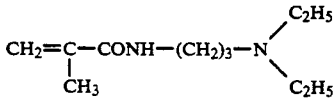

Particularly suitable and preferred compounds of the formula Ia are the above-indicated compounds in quaternised form, in particular when the quaternary nitrogen atom has bonded to it three identical radicals, as for example in the following compounds of the formula Ia:

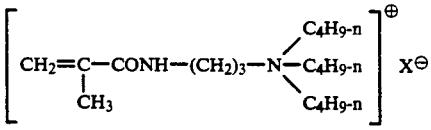

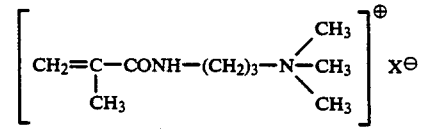

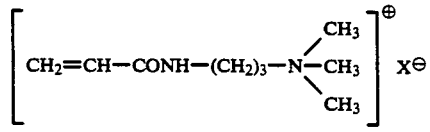

Of the compounds of the formula IIa, those where $R^7$=$R^9$—CH=C($R^8$)—$CH_2$—, preferably the dimethyldiallylammonium compounds, in particular the dimethyldiallylammonium chloride, are preferred.

As N-containing basic monomers it is also preferable to use for example vinyl- or isopropenyl-containing 5- or 6-ring compounds of the formula III

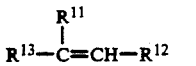

(III)

where $R^{11}$ and $R^{12}$ are each H or $—CH_3$ and $R^{13}$ is a 5- or 6-membered heterocyclic radical which contains at least one basic nitrogen atom and which can also have a fused-on benzene ring and/or be monosubstituted or polysubstituted. Suitable as substituents for $R^{13}$ are in particular $C_1$–$C_4$alkyl and $C_2$–$C_4$hydroxyalkyl, which radicals may likewise be straight-chain or branched. If substituted, $R^{13}$ is preferably monosubstituted or disubstituted. $R^{12}$ is preferably hydrogen.

The 5-membered heterocyclic radical $R^{13}$ can be saturated or unsaturated and be for example one of the following radicals: imidazolyl, imidazolinyl, pyrrolyl, pyrrolinyl, pyrrolidinyl, indolyl.

As 5-membered ring compounds of the formula III it is possible to mention for example the following:

N-vinylimidazole, 1-vinyl-2-imidazoline, 2-vinyl-4-(or 5-)methyl-2-imidazoline, 1-vinyl-2-methylimidazole, 1-vinyl-4-(2-hydroxymethyl)-imidazole, N-vinylpyrrole, 2-isopropenyl-2-imidazoline, 1-vinyl-2,4-dimethylimidazole.

The 6-membered heterocyclic radical $R^{13}$ can be saturated or unsaturated, being for example a pyridinyl or quinolinyl radical.

Suitable 6-membered ring compounds of the formula III are for example 2-vinylpyridine, 3-vinylpyridine, 4-vinylpyridine, 3-isopropenylpyridine, 2-vinyl-quinoline, 2-methyl-3-vinyl-8-hydroxy-quinoline, 2-vinylquinoline, 2-methyl-3-vinylisoquinoline, 1-methyl-5-vinyl-isoquinoline, 2-isopropenylquinoline. Vinylpyridine and derivates thereof are particularly preferred.

The polymer grafted onto the cellulose can consist of monomer units of one or more compounds of the formula I, Ia, II, IIa and/or III. It may also contain yet other polymerisable monomers. The polymer grafted onto the cellulose contains for example from 20 to 100 mol %, preferably from 40 to 100 mol %, very particularly preferably from 80 to 100 mol %, of one or more compounds of the formula I, Ia, II, IIa and/or III. The sharing-out between the monomers of the formulae I, Ia, II, IIa and/or III is a matter of choice. Normally, the graft polymer contains only one of the compounds I, Ia, II, IIa and/or III. That is, a cellulose grafted with a homopolymer consisting of copolymerised monomer units of the formulae I, Ia, II, IIa and/or III is preferred.

The copolymers grafted onto the cellulose may, as well as the copolymerised monomers of the formulae I, Ia, II, IIa and/or III also contain one or more other monomers, in particular one or more amides of the formula IV

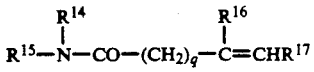

(IV)

and/or one or more esters of the formula V

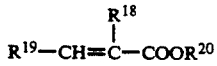

(V)

where $R^{14}$ and $R^{15}$ are each hydrogen, $C_1$–$C_6$alkyl, $C_5$–$C_7$-cycloalkyl, $C_2$–$C_4$-hydroxyalkyl or $R^{14}$ and $R^{15}$ together with the nitrogen atom to which they are bonded form a five- or six-membered ring which may additionally contain —O—, —S—, —N= or —NH—, $R^{16}$, $R^{17}$, $R^{18}$ and $R^{19}$ are each hydrogen or methyl, $R^{20}$ is $C_1$–$C_6$alkyl, and q is 0, 1, 2 or 3.

The radicals in the formulae IV and V are mutatis mutandis subject to the same remarks and examples as the analogous radicals in the formulae I to III.

Examples of compounds of the formula IV are acrylamide and methacrylamide. Examples of compounds of the formula V are $C_1$–$C_6$alkyl esters, in particular the methyl and ethyl esters of acrylic and methacrylic acid.

The mono- or copolymers are grafted onto the cellulose by polymerising one or more monomers of the formula I, Ia, II, IIa and/or III in the presence or absence of one or more monomers, in particular of the formula IV and/or V.

The polymerisation/copolymerisation takes place in a suitable solvent. Suitable solvents are mixtures of water with a water-miscible solvent. Suitable water-miscible solvents are for example lower alcohols, e.g. methanol, ethanol, n-propanol, i-propanol, n-butanol, tert-butanol, glycols and diols, e.g. ethylene glycol, propylene glycol, 1,3-propanediol, di- and polyglycols, e.g. diethylene glycol, triethylene glycol, glycol ethers, e.g. diethylene glycol monomethyl ether, diethylene glycol monoethyl ether, ethylene glycol monomethyl ether, ethylene glycol monoethyl ether, ethylene glycol mono-n-propyl ether, ethylene glycol mono-n-butyl ether, ethylene glycol dimethyl ether, ethylene glycol diethyl ether and ketones, e.g. acetone or methyl ethyl ketone.

The homo/copolymerisation in the presence of cellulose can also be carried out in a mixture of various solvents which contains water. If one or more components are used in the form of aqueous solutions, it is normally not necessary to add any further water. Preference is given to water mixed with alcohols, in particular those of 1 to 4 carbon atoms, and mixed with diols and glycols. It can be advantageous during homo- or copolymerisation to add further organic solvent or solvent mixture in portions once or in particular more than once.

Before start of the homo- or copolymerisation it is advantageous to adjust the pH to values of 3 to 11.5, preferably 3 to 8.5. This pH adjustment is in general effected with an acid, preferably an organic acid, in particular formic acid, acetic acid, glycolic acid and/or citric acid.

The homo- or copolymerisation is carried out in the presence of cellulose at room temperature or in particular at an elevated temperature, for example at from 40° to 100° C., preferably at from 60° to 90° C., very particularly preferably at from 65 to 85° C., and is started in a conventional manner, for example by the addition of suitable initiators, by heating, by the action of high-energy radiation, for example UV rays, by microwaves or the action of ultrasound. Suitable initiators are free radical generators, for example benzoyl peroxide, tertbutyl hydroperoxide, cumene peroxide, methyl ethyl ketone peroxide, lauryl peroxide, tertbutyl perbenzoate, di-tert-butyl perphthalate, azobisisobutyronitrile, 2,2'-azobis(2,4-dimethylvaleronitrile), 2-phenyl-azo-2,4-dimethyl-4-methoxyvaleronitrile, 2-cyano-2-propyl-azo-formamide, azodiisobutyramide, dimethyl, diethyl or di-n-butyl azobismethylvalerate, tert-butyl perneodecanoate, diisononanoyl peroxide, tert-amyl perpivalate, di-2-ethylhexyl peroxidicarbonate, dilauroyl peroxide, di-isotridecyl peroxydicarbonate, tert-butyl-peroxyisopropyl percarbonate. The initiator used is preferably 2,2'-azobis(2-amidinopropane) dihydrochloride, 2,2'-azobis(2-imidazol-2-ylpropane) dihydrochloride, 2,2'-azobis(2-carbamoylpropane) dihydrate or 2,2'-azobis(2-methoxycarbonylpropane). Based on the quantity of monomer, from 0.01 to 2% by weight, preferably from 0.1 to 2% by weight, of initiator is used. It is advantageous to carry out the polymerisation/-copolymerisation or grafting in the absence of oxygen. This can be effected in a conventional manner by purging with an inert gas, for example nitrogen. The monomer components are used in such amounts that the polymer grafted onto the cellulose contains at least 20 mol %, preferably at least 40 mol %, very particularly preferably at least 80 mol %, of one or more compounds of the formula I, Ia, II, IIa and/or III in copolymerised form.

The grafting can be carried out for example by introducing the cellulose to be grafted into the polymerisation vessel together with the solution of the monomer(s) and carrying out the homo- or copolymerisation. Under these conditions, the homo- or copolymerisation will normally have ended after about 30 min to about 4 h, in many cases after 30 min to 2½ h.

The cellulose is then removed from the polymerisation vessel, freed of surface liquid, for example by squeezing off, rinsed with water and dried.

However, the grafting of the cellulose can also be carried out by applying the monomer solution to the cellulose, for example by slop padding, nip padding, soaking or spraying, and initiating the homo- or copolymerisation at room temperature or elevated temperature, advantageously through the action of high-energy radiation or of ultrasound. It is frequently sufficient here to irradiate or sonicate for about 0.5 to 10 min and then to store the cellulose in the moist state for another 2 to 36 h, preferably 10 to 24 h, and thereafter, and following possible rinsing, to dry it.

It is possible to graft the cellulose, present for example as cellulose fibre, e.g. as linen, jute, ramie fibre or as regenerated cellulose fibre, preferably as cotton fibre, with the polymer or copolymer mentioned in any processing state, for example as yarn, fibre, slubbing or piece material. To dye with anionic sulphur dyes it is particularly suitable to have as substrate a cellulose which has been modified as described by grafting with 0.5 to 40% by weight, preferably from 2 to 25% by weight, very particularly preferably from 4 to 15% by weight, based on the cellulose, of polymer.

Cellulose, for example in the form of cotton or viscose staple or as cellulose portion in blend fabrics, for example in cellulose/polyester blend fabrics and modified or grafted in the manner described, can be dyed with sulphur dyes which can be dissolved without addition of reducing agents, i.e. in particular with so-called water-soluble sulphur dyes, without application of a prereduction or of reducing agents and electrolyte salts and without use of separate specific oxidising agents at standard or room temperature or at a slightly elevated temperature of up to for example about 60° to 75° C. These so-called water-soluble sulphur dyes are in particular thiosulphuric acid derivatives of sulphur dyes (Bunte salts of sulphur dyes). The end-use fastness properties obtained with good fixation yield are good, in particular the light fastness and the rub fastness properties, and in many cases exceed the fastness results obtained from water-soluble sulphur dyes in the processes of EP-A-0277580.

In dyeing the dye concentration for a given wet pick-up, which is normally from 100 to 200%, depends on the desired depth of shade. In general, the dyeing liquors contain from 10 to 50 g/l of the water-soluble sulphur dye. The water-soluble sulphur dyes, if in powder form, are normally dissolved in warm, or if necessary boiling, softened water. Since no reducing agents are required, these dyeing solutions are impervious to oxidative influences and thus very stable. Liquid water-soluble sulphur dyes are diluted with softened water.

Dyeing can be effected by various methods, for example on the jigger, from the reel beck or in dyeing machines from a long or short liquor. Yarn, fibre and slubbing are dyed for example in machines in which the liquor is recirculated. Piece goods are advantageously dyed in jet machines.

The liquor ratio is adapted to the dyeing process and normally ranges from 1:3 to 1:20. The dyeing temperature is in general lower than in prior art processes for dyeing with sulphur dyes. The process according to the present invention uses for example dyeing temperatures ranging from room temperature to about 60°–75° C., so that it is also possible to employ the cold pad-batch process.

As sulphur dyes which are water-soluble without the addition of reducing agents there come into consideration in particular the so-called water-soluble sulphur dyes. These so-called water-soluble sulphur dyes are, as mentioned earlier, obtained in particular by modification of the actual sulphur dyes with sulphite and/or bisulphite and represent in particular thiosulphuric acid derivatives or Bunte salts of sulphur dyes. (The actual sulphite dyes are prepared from aromatic compounds by heating together with elemental sulphur or by prolonged boiling with polysulphide in water or alcohols.) The so-called water-soluble sulphur dyes are listed in the Colour Index under C.I. Solubilised Sulphur. Of these C.I. solubilised sulphur dyes in particular the following are suitable: Black 1, Brown 1, Blue 2, Blue 7, Brown 12, Red 11, Brown 15, Blue 11, Green 3, Brown 46, Red 6, Brown 93, Blue 10, Brown 16, Brown 51, Brown 52, Green 2, Green 19, Green 9, Green 24, Yellow 5, Yellow 20, Brown 60, Yellow 19, Brown 21, Brown 10.

The dyeing liquors may also contain assistants, for example wetting and/or padding assistants, in concentrations customary in the state of the art.

After the actual dyeing process it is only necessary to carry out a single or repeated second wash.

Normally, the second wash can even be replaced by rinsing with water. The second wash or rinsing can be carried out at room temperature or at a slightly elevated temperature of about 50° to 60° C. This is followed by drying, for example at from 50° to 60° C. The application of a separate oxidising agent is not necessary.

For dyeing with sulphur dyes which are water-soluble without addition of reducing agents, i.e. in particular for dyeing with so-called water-soluble sulphur dyes, the process according to the present invention offers appreciable ecological and economic advantages through savings in chemicals (elimination of reducing agents, electrolyte salts, oxidising agents) and energy. Moreover, good end-use fastness properties are achieved.

In the examples which follow, the percentages are by weight. Examples 1 to 10 concern the preparation of the grafted substrates to be used in the process according to the present invention and Examples 11 to 14 concern the practice of dyeing by the process according to the present invention.

EXAMPLE 1

A 5-liter 3-neck flask equipped with a horseshoe stirrer, a nitrogen inlet tube and reflux condenser is fitted on the inside with a piece of cotton cloth 2.8 g in weight and 8×30 cm in size. This is followed by the introduction of:

1000 ml of distilled water,
113.3 g of sodium chloride,
573 mg of disodium ethylenediaminetetraacetate,
2372.5 g of dimethyldiallylammonium chloride as 61% aqueous solution, the flask is evacuated and inertised with nitrogen 3 times, and the contents are heated under 380–400 mbar to 80° C.

At that temperature 64.5 g of a 5.25% ammonium persulphate solution are then metered in with stirring, which is followed by 1 h of heating, then a further 54 g of a 12.5% ammonium persulphate solution are metered in, and the batch is heated at 80° C. for one hour.

Then a further 118 g of an aqueous ammonium persulphate solution are metered in and the batch is polymerised to completion at 80° to 83° C. over 2 h.

The cotton cloth is then removed from the reaction flask, squeezed off, rinsed off twice with 500 ml of water each time, squeezed off in between and dried at 100° C. for 5 min. The uptake of polymer is 5.3%.

EXAMPLE 2

A 5-liter three-neck flask equipped with a horseshoe stirrer, a gas inlet tube and reflux condenser is fitted on the inside with a piece of cotton cloth 5.4 g in weight and 8×60 cm in size and then charged with 90 g of NaCl dissolved in 1000 ml of water,
130.9 g of dimethylaminopropylmethacrylamide,
319.5 g of ethanol,
407 mg of disodium ethylenediaminetetraacetate.

231 g of glacial acetic acid are added to set a pH of from 8.5 to 9.0, 960 g of water are added, and 2060 mg of 2,2'-azobis(2-amidinopropane) dihydrochloride are added as initiator, and the flask is then evacuated and inertised with nitrogen 3 times and heated to 79°–80° C.

As soon as the internal temperature is 80° C., ethanol is added in successive portions of 45.8 g of ethanol
38.5 g of ethanol
93 g of ethanol and finally
322.5 g ethanol.

Between additions the batch is stirred for 15 min and finally polymerised to completion at 80° C. over 2 h. The cotton cloth is then removed from the flask, rinsed 3 times with 200 ml of water each time, each time being squeezed off in between, and then dried for 5 min. The uptake of polymer is 4.9%.

The active substance concentration of polymer is 25%. The K value of a 1% strength aqueous solution is 112600.

EXAMPLE 3

In a repeat of Example 2 the cotton cloth is replaced by a viscose staple cloth 3.4 g in weight and 8×47 cm in size. The uptake of polymer is 2.95%.

EXAMPLE 4

In a repeat of Example 3 the cotton cloth is replaced by an equally sized cloth of 65/35 polyester-cotton 5.7 g in weight. The uptake of polymer is 3.4%.

EXAMPLE 5

A 3-liter three-neck flask equipped with a horseshoe stirrer, a gas inlet tube and reflux condenser is charged with a solution of 200 g of distilled water
56.7 g of sodium chloride
287 mg of disodium ethylenediaminetetraacetate,
250 g of ethanol,
1210 g of dimethyldiallylammonium chloride as 61% strength aqueous solution.

The batch is then adjusted with 9.5 g of glacial acetic acid to a pH of 3.7–3.8 and diluted with 368.8 g of ethanol. The monomeric substance content is 34.7%.

827 g of this 34.7% strength monomer solution are introduced into a beaker and a piece of cotton cloth 11.6 g in weight and 100×25 cm in size is dipped into the solution and ultrasonicated for 30 min. The cotton cloth is then squeezed off and stored moist at room temperature for 24 h. The uptake of polymer is 37%.

EXAMPLE 6

A solution of 200 ml of water,
18.1 g of sodium chloride,
206.18 g of dimethylaminopropylmethacrylamide,
63.9 g of ethanol and
81.4 mg of disodium ethylenediaminotetraacetate is adjusted with glacial acetic acid to a pH of 8.5–9.0 and applied on a pad-mangle to a cotton cloth and squeezed off. The liquor pick-up after squeeze-off is 114.4%.

The moist cloth is then subjected to a microwave treatment (30 seconds at 90 watts and then 4 times 30 seconds at 720 watts).

The moist cloth is then left at room temperature for 24 h and thereafter dried at 100° C. over 5 minutes. The uptake of polymer is 29.5%.

EXAMPLE 7

The monomer solution indicated in Example 6 is applied in the manner indicated in Example 6 to a cotton cloth and squeezed off. The moist cloth is then subjected to UV irradiation in order to initiate polymerisation and grafting.

The aftertreatment of the cloth is effected as indicated in Example 6. The uptake of polymer is 30.8%.

EXAMPLE 8

A 5-liter three-neck flask equipped with a horseshoe stirrer, a gas inlet tube and a reflux condenser holds a piece of 30/70 cotton/polyester blend fabric 5.7 g in weight and 8×60 cm in size.

Then 800 g of distilled water are introduced,
127.5 g of NaCl are dissolved and then
1452 g of dimethylaminopropylmethacrylamide,
713.6 g of ethanol and 573 mg of disodium ethylenediaminetetraacetate are added and adjusted to pH 8–9 with 246.4 g of glacial acetic acid.

This is followed by the addition of 2.9 g of 2,2'-azobis-2-amidinopropane dihydrochloride and 290.5 g of water.

This monomer solution is stirred at 20° to 25° C. for 1 h. The cotton/polyester cloth is squeezed off and divided into 2 parts. The two parts are then subjected to the following treatments:

A. The 1st part of cloth is subjected to a microwave treatment at 90 watts for 30 seconds and 720 watts for 2 minutes. It is then dried at 100° C. for 5 minutes. The uptake of polymer is 7.9% on weight of fibre.

B. The 2nd part of the cloth is subjected to UV irradiation for 15 minutes and then likewise dried at 100° C. for 5 minutes. The uptake of polymer is 9.11% on weight of fibre.

EXAMPLE 9

A 5-1 three-neck flask equipped with a horseshoe stirrer, a gas inlet tube and a reflux condenser holds a piece of cotton cloth 5.7 g in weight and 8×60 cm in size.

Then 200 ml of distilled water are introduced and 127.5 g of NaCl dissolved therein and then 1186.3 g of dimethyldiallylammonium chloride as 61.2% strength aqueous solution, 1452 g of trimethylammoniumpropylmethacrylamide, 573 mg of disodium ethylenediaminetetraacetate and 450 g of ethanol are added in succession and adjusted with 1.0 g of glacial acetic acid to pH 6.0. 76.9 g of ethanol are added, followed by 2.9 g of 2,2'-azobis-2-amidinopropane dihydrochloride as initiator, and the batch is heated to an internal temperature of 78° to 80° C. under a stream of nitrogen.

As soon as the internal temperature has reached 78° to 80° C., the polymerisation and grafting starts with a temperature increase to 84° C. After the polymerisation has ended, 64.5 g, 54.2 g, 118.4 g and 453 g of ethanol are added in succession at intervals of 10 to 15 minutes and after the last portion has been added the batch is stirred at 77° to 80° C. for 1 h. The cloth is then removed and aftertreated as in Example 1. The uptake of polymer is 14.6%.

EXAMPLE 10

A 5-1 three-neck flask equipped with a horseshoe stirrer, a gas inlet tube and a reflux condenser holds a piece of cotton cloth 5.6 g in weight and 8×60 cm in size.

The flask is then charged in succession with 100 g of distilled water, 127.5 g of NaCl, 1452 g of trimethylammoniumpropylmethacrylamide chloride as 50% aqueous solution, 726 g of dimethylaminopropylmethacrylamide, 573 mg of disodium ethylenediaminetetraacetate, 450 g of ethanol and 638.2 g of glacial acetic acid.

This is followed by 2.9 g of 2,2'-azobis-(-2-amidinopropane) dihydrochloride as initiator, and the batch is heated to 80° C. under a stream of nitrogen. The polymerisation starts as soon as the temperature of 80° C. has been reached and then the temperature rises to 89° C. Thereafter portions of 64.5 g, 54.2 g, 118.4 g and 400 g of ethanol are added and after each addition the batch is stirred for 10 min and at the end of the additions it is heated at 78° to 80° C. for 2 h.

The polymer solution obtained is found to have a content of 38.04%. (To determine the content, a sample was heated at 120° C. under a pressure of 200 mbar for 2 h.) The viscosity of the solution is found to be 44.6 sec in the DIN cup/nozzle diameter 6 mm.

The cloth is removed and aftertreated as in Example 1. The uptake of polymer is 4.7%.

EXAMPLE 11

A cotton cloth treated as described in Example 10 is dyed with 2.5%, based on weight of fibre, of the commercial dye solubilised sulphur Blue 7 at 60° C. in a liquor ratio of 20:1 for 35 min. No salts and no reducing agents are used.

The dyed material is rinsed cold with water and then dried.

The result obtained is a strong dyeing having good fastness properties. The light fastness obtained is 4 and the dry rub fastness is 5.

EXAMPLE 12

A cotton cloth treated and dried as described in Example 10 is dyed with 2.5% of the commercial product C.I. Solubilised Sulphur Red 11 by pad-mangle application without the addition of salts and reducing agents, stored at room temperature for 12 h, rinsed cold with water and dried at 50° C.

The fastness properties obtained are 3 to 4 for the light fastness and 5 for the dry rub fastness.

EXAMPLE 13

A cotton cloth treated as described in Example 8—Part A is dyed with 2.5%, based on weight of fibre, of the commercial dye C.I. Solubilised Blue 7 by pad-mangle impregnation, stored at room temperature for 12 hours, rinsed cold with water and dried at 50° C.

The fastness properties obtained on the dyeing are 3 to 4 for the light fastness and 5 for the dry rub fastness.

EXAMPLE 14

A cotton cloth treated as described in Example 8—Part B is dyed with 2.5%, based on weight of fibre, of the commercial dye C.I. Solubilised Sulphur Red 11 by pad-mangle application, stored at room temperature for 12 hours, rinsed cold with water and dried at 50° C.

The light fastness of the dyed material is 3 to 4 and the dry rub fastness is 5.

Similar fastness properties as in Examples 11 to 14 are obtained on using in Examples 11 to 14 the grafted substrates prepared as described in Examples 1 to 7 and 9 and/or the dyes C.I. Solubilised Sulphur Black 1 and C.I. solubilised Sulphur Blue 11.

We claim:

1. Process for dyeing cellulose with sulphur dyes which are water-soluble thiosulphuric acid derivatives of sulphur dyes without addition of reducing agents, characterised in that the substrate used is a cellulose onto which a polymer has been grafted by polymerising at least one N-containing basic monomer onto the cellulose wherein N-containing basic monomer comprising a compound of the formulae I, Ia, II, IIa or III

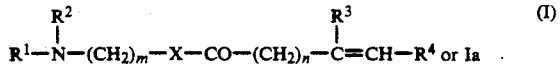

(I)

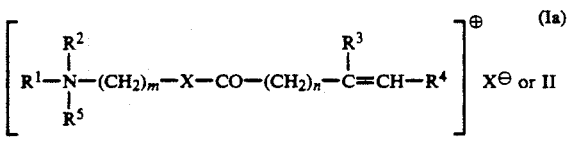

(Ia)

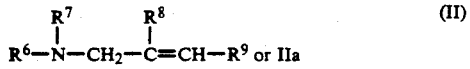

(II)

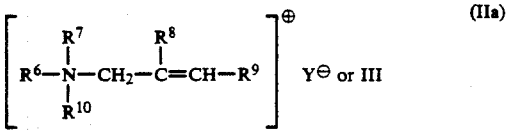

(IIa)

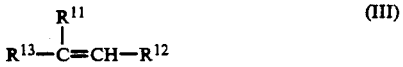

(III)

or a mixture thereof where $R^1$, $R^2$, $R^6$ and $R^7$ are each hydrogen, $C_1$–$C_6$alkyl, $C_5$–$C_7$cycloalkyl, $C_2$–$C_4$hydroxyalkyl, $R^7$ is optionally $R^9$—CH=C($R^8$)—$CH_2$—, or $R^1$ and $R^2$, $R^6$ and $R^7$ together with the nitrogen atom to which they are bonded form a 5- or 6-membered ring which optionally additionally contains —O—, —S—, —N= or —NH—, wherein the 5- or 6-membered ring is selected from the group consisting of pyrrolidinyl, piperidino, pyrrolyl, pyridinyl, piperazinyl, morpholino and thiomorpholino, X is —O— or —NH—, $R^3$, $R^4$, $R^8$, $R^9$, $R^{11}$, $R^{12}$ are each H or $CH_3$, is 1, 2, 3, 4, 5 or 6, n is 0, 1, 2, 3 or 4, $R^5$ and $R^{10}$ are each $C_1$–$C_6$ alkyl, phenyl-$C_1$–$C_4$ alkyl or phenyl-(O—$CH_2CH_2$)$_p$-, $R^{13}$ is imidazolyl, imidazolinyl, pyrrolyl, pyrrolinyl, pyrrolidinyl, indolyl, pyridinyl or quinolinyl which optionally are monosubstituted or polysubstituted with $C_1$–$C_4$-alkyl or $C_2$–$C_4$-hydroxyalkyl in which the $C_1$–$C_4$-alkyl and the $C_2$–$C_4$-hydroxyalkyl may be straight-chained or branched, P is 1, 2, 3 or 4, $X^{\oplus}$ and $Y^{\ominus}$ are each a monovalent anion or one equivalent of a polyvalent anion.

2. Process according to claim 1 characterised in that from 0.5 to 40% by weight of the polymer has been grafted onto the cellulose the weight % being based on the cellulose.

3. Process according to claim 2 characterised in that from 2 to 25% by weight of the polymer has been grafted onto the cellulose.

4. Process according to claim 3 characterised in that from 4 to 15% by weight of polymer has been grafted onto the cellulose.

5. Process according to claim 1 characterised in that the grafted cellulose used has had grafted onto it a copolymer which, in addition to one or more units from the monomers of the formulae I, Ia, II, IIa or III, also contains units from one or more amides of the formula IV

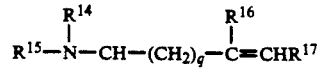

(IV)

or one or more esters of the formula V

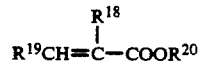

(V)

where $R^{14}$ and $R^{15}$ are each hydrogen, $C_1$–$C_6$-alkyl, $C_5$–$C_7$ cycloalkyl, $C_2$–$C_4$-hydroxyalkyl or $R^{14}$ and $R^{15}$ together with the nitrogen atom to which they are bonded form a five- or six-membered ring which optionally additionally contain —O—, —S—, —N= or —NH—, wherein the 5- or 6-membered ring is selected from the group consisting of pyrrolidinyl, piperidino, pyrrolyl, pyridinyl, piperazinyl, morpholino and thiomorpholino, $R^{16}$, $R^{17}$, $R^{18}$ and $R^{19}$ are each hydrogen or methyl $R^{20}$ is $C_1$–$C_6$alkyl, and q is 0, 1, 2 or 3.

6. Process according to claim 1 characterised in that the copolymer-grafted cellulose used contains at least 20 mol % of one or more monomers of the formulae I, Ia, II, IIa or III.

7. Process according to claim 6 characterised in that the copolymer-grafted cellulose used contains at least 40 mol % of one or more monomers of the formulae I, Ia, II, IIa or III.

8. Process according to claim 6 characterised in that the copolymer-grafted cellulose used contains at least 80 mol % of one or more monomers of the formulae I, Ia, II, IIa or III.

9. Process according to claim 1 characterised in that dyeing takes place at temperatures from room temperature to about 75° C.

10. Process according to claim 1 characterised in that dyeing takes place at temperatures from room temperature to about 60° C.

11. Process according to claim 1 characterised in that dyeing takes place without the addition of an electrolyte salt.

12. Process according to claim 1 characterised in that the graft polymer on the cellulose used contains a compound of formula I or II where X=—NH— or a compound of formula IIa where $R^7$=$R^9$ —CH=C($R^8$)—$CH_2$—.

13. Process according to claim 1 characterised in that the cellulose used has been grafted with a homopolymer.

14. Process according to claim 1 characterised in that the grafted cellulose used is in the form of grafted linen, jute or ramie fibres or in the form of fibres of grafted regenerated cellulose.

15. Process according to claim 1 characterised in that the grafted cellulose used is in the form of fibres of grafted cotton.

16. A process according to claim 1, wherein $R^7$ is cyclohexyl or dimethyldiallylammonium chloride and $R^{10}$ is selected from the group consisting of benzyl, phenethyl, 3-phenylpropyl, 2-phenylpropyl, 3-phenylbutyl, 4-phenylbutyl, phenyl-($OCH_2CH_2$)-, phenyl-($OCH_2CH_2$)$_2$— and phenyl-($OCH_2CH_2$)$_4$.

17. A process according to claim 16, wherein $R^7$ is cycloalkyl and $R^{10}$ is benzyl, 18. A process according to claim 1, wherein compounds of formula I are selected from the group consisting of

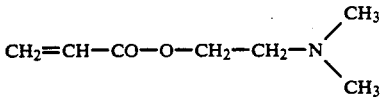

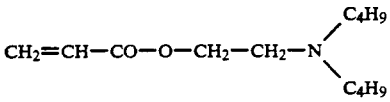

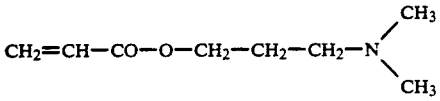

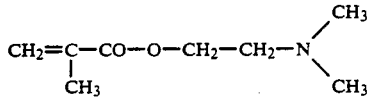

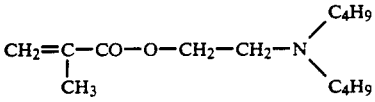

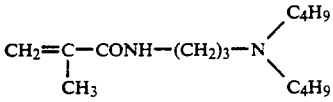

-continued

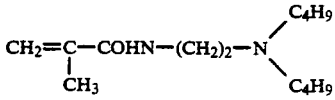

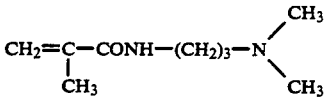

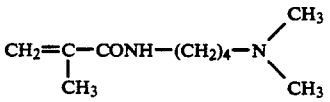

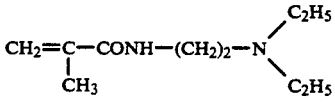

and

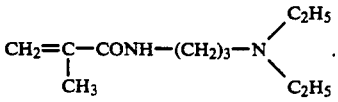

19. The process according to claim 1, wherein $R^{13}$ is selected from the group consisting of N-vinylimidazole, 1-vinyl-2-imidazoline, 2-vinyl-4-(or 5-)-methyl-2-imidazoline, 1-vinyl-2-methyl-imidazole, 1-vinyl-4-(2-hydroxymethyl)-imidazole, N-vinylpyrrole, 2-isopropenyl-2-imidazoline, 1-vinyl-2,4-dimethylimidazole, 2-vinylpyridine, 3-vinylpyridine, 4-vinylpyridine, 3-isopropenylpyridine, 2-vinyl-quinoline, 2-methyl-3-vinyl-8-hydroxy-quinoline, 2-vinyl-quinoline, 2-methyl-3-vinylisoquinoline, 1-methyl-5-vinyl-isoquinoline and 2-isopropylenequinoline.

20. The process according to claim 19, wherein $R^{13}$ is selected from the group consisting of 2-vinylpyridine, 3-vinylpyridine, 4-vinylpyridine and 3-isopropenylpyridine.

* * * * *